US009084497B2

(12) United States Patent
Hawkins

(10) Patent No.: US 9,084,497 B2
(45) Date of Patent: Jul. 21, 2015

(54) BIN-TYPE DISPLAY FIXTURE

(71) Applicant: Target Brands, Inc., Minneapolis, MN (US)

(72) Inventor: Laura L. Hawkins, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 329 days.

(21) Appl. No.: 13/711,186

(22) Filed: Dec. 11, 2012

(65) Prior Publication Data

US 2014/0158655 A1 Jun. 12, 2014

(51) Int. Cl.

| | |
|---|---|
| ***A47F 5/00*** | (2006.01) |
| ***A47F 3/14*** | (2006.01) |
| ***A47F 5/11*** | (2006.01) |

(52) U.S. Cl.

CPC ..... *A47F 3/142* (2013.01); *A47F 5/0018* (2013.01); *A47F 5/114* (2013.01); *Y10T 29/49826* (2015.01)

(58) Field of Classification Search

CPC ..... A47F 5/02; A47F 5/04; A47F 5/05; A47F 5/112; A47F 5/114; A47F 5/11; A47F 5/105; A47F 5/108; A47F 5/10; A47F 5/0025; A47F 3/14; A47F 3/05; A47F 3/10; A47F 7/144; A47F 5/0018; A47F 3/142; A47B 49/004; A47B 87/0253; A47B 87/0246; A47B 87/0215; A47B 87/0207

USPC ..... 211/126.2, 126.14, 126.16, 131.1, 211/132.1, 163, 45

See application file for complete search history.

(56) References Cited

U.S. PATENT DOCUMENTS

| | | | | | |
|---|---|---|---|---|---|
| 1,577,207 | A | | 3/1926 | Dieperink-Langereis | |
| 1,881,423 | A | | 10/1932 | Favreau | |
| 1,934,846 | A | * | 11/1933 | Ebert | 108/101 |
| 2,108,122 | A | * | 2/1938 | Hall | 211/128.1 |
| D135,377 | S | * | 3/1943 | Cameron | D21/303 |
| 2,526,246 | A | * | 10/1950 | Leeper | 108/101 |
| 2,626,059 | A | * | 1/1953 | Turner | 211/44 |
| 3,483,742 | A | | 12/1969 | Murray | |
| 4,026,220 | A | * | 5/1977 | Schuring, Jr. | 108/101 |
| 4,030,608 | A | * | 6/1977 | Howard | 211/131.1 |
| 4,140,223 | A | * | 2/1979 | Rau et al. | 211/78 |
| 4,315,376 | A | | 2/1982 | Eichenauer | |
| 4,550,839 | A | * | 11/1985 | Good | 211/189 |
| 4,700,850 | A | * | 10/1987 | Morgan et al. | 211/131.1 |

(Continued)

OTHER PUBLICATIONS

Office Action from Canadian Patent Application No. 2,810,680, mailed Jul. 4, 2013 (3 pages).

(Continued)

*Primary Examiner* — Patrick Hawn

(74) *Attorney, Agent, or Firm* — Leanne Taveggia Farrell; Westman, Champlin & Koehler, P.A.

(57) ABSTRACT

A display fixture includes a plurality of tiers stacked one on top of another. Each tier includes a substantially horizontally oriented tray and a plurality of dividers. The plurality of dividers are oriented substantially vertically and divide a volume between each tray into a plurality of bins. Each divider structurally supports a weight of the display fixture and a weight of merchandise located in the bins of the display fixture that are located above each divider. The plurality of tiers together resemble a three-dimensional seasonal decoration when viewed from each side of the display fixture.

20 Claims, 14 Drawing Sheets

(56) References Cited

U.S. PATENT DOCUMENTS

| | | | | | |
|---|---|---|---|---|---|
| D307,987 | S | | 5/1990 | Bustos | |
| 4,964,520 | A | * | 10/1990 | Kilmartin, III | 211/131.1 |
| D325,134 | S | | 4/1992 | Bustos | |
| 5,251,753 | A | * | 10/1993 | Pigott et al. | 206/766 |
| 5,487,599 | A | * | 1/1996 | Weisburn et al. | 312/9.46 |
| 5,524,775 | A | * | 6/1996 | Kaine | 211/131.1 |
| 5,735,415 | A | | 4/1998 | Wilson | |
| 5,758,783 | A | * | 6/1998 | Maglione | 211/126.2 |
| D414,056 | S | | 9/1999 | Palm et al. | |
| 5,984,120 | A | * | 11/1999 | Johnske | 211/132.1 |
| D438,729 | S | | 3/2001 | Sikora | |
| 6,227,370 | B1 | * | 5/2001 | Earnshaw et al. | 206/497 |
| 6,267,255 | B1 | * | 7/2001 | Brush | 211/59.4 |
| D447,889 | S | * | 9/2001 | Finlay | D6/474 |
| 6,425,646 | B1 | * | 7/2002 | Andrews | 312/114 |
| 6,439,406 | B1 | * | 8/2002 | Duhon | 211/131.1 |
| 6,488,200 | B1 | * | 12/2002 | Jensen, Jr. | 229/122.3 |
| 6,811,836 | B1 | | 11/2004 | Johnson et al. | |
| 7,144,610 | B1 | | 12/2006 | Estes et al. | |
| 7,568,582 | B1 | * | 8/2009 | Berger | 211/74 |
| 8,640,891 | B2 | * | 2/2014 | Buttigieg | 211/131.1 |

OTHER PUBLICATIONS

Displays2go, "Cardboard Display: Corrugated Blue," 1 page, http://www.displays2go.com/Product.aspx?ID=11637, at least as early as Aug. 2012.

Haiyea, "Bed sheet floor Dump bin display cardboard stands for supermarket promotion," 1 page, http://www.cardboard-displaystands.com/china-bed_sheetfloor_dump_bin_display_cardboard_stands_for_supermarket_promotion-405122.html, at least as early as Aug. 2012.

Office Action from Canadian Patent Application No. 2,810,680, mailed Dec. 4, 2013 (4 pages).

Office Action from Canadian Patent Application No. 2,810,680, mailed Mar. 25, 2014 (2 pages).

* cited by examiner

BIN-TYPE DISPLAY FIXTURE

BACKGROUND

In retail stores, seasonal merchandise is often placed in temporary bins for display. Within the bins, the seasonal merchandise must be easily accessible and visually pleasing in order to attract consumer traffic.

The discussion above is merely provided for general background information and is not intended to be used as an aid in determining the scope of the claimed subject matter.

SUMMARY

A display fixture includes a plurality of tiers stacked one on top of another. Each tier includes a substantially horizontally oriented tray and a plurality of dividers. The plurality of dividers are oriented substantially vertically and divide a volume between each tray into a plurality of bins. Each divider structurally supports a weight of the display fixture and a weight of merchandise located in the bins of the display fixture that are located above each divider. The plurality of tiers together resemble a three-dimensional seasonal decoration when viewed from each side of the display fixture.

A method of displaying merchandise in bins of a display fixture that resembles a three-dimensional seasonal decoration is also included. A first four-sided tray is mounted on a base and a plurality of rectilinear dividers are mounted on the first four-sided tray to form a plurality of bins in at least one lower tier of the display fixture. Each divider of the at least one lower level is oriented substantially normal to the sides of the tray. A second four-sided tray is mounted on the plurality of rectilinear dividers of the at least one lower level and a plurality of rectilinear dividers are mounted on the second four-sided tray to form a plurality of bins in at least one upper tier of the display fixture. Each divider of the at least one upper level is oriented at an angle relative to the sides of the tray that is less than 90 degrees. The plurality of bins of the at least one lower tier and the plurality of bins of the at least one upper tier are stocked with merchandise.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Display fixtures having a plurality of tiers or levels with bins or receptacles for holding and displaying merchandise are described below. Each tier or level has a substantially horizontally oriented tray and a plurality of partitions or dividers that are substantially vertically oriented. Each tray includes four sides and is in the shape of a square. Together, the plurality of tiers or levels resemble a three-dimensional seasonal decoration. For example and as illustrated in the figures, the three-dimensional seasonal decoration can be a Christmas tree.

Brick and mortar retail stores, such as department stores, carry an assortment of soft and hard goods that are arranged throughout the floor space of the store in department categories such that a customer can go to a certain area in the store to select the goods that they would like to purchase. Example department categories include grocery, accessories, shoes, children's clothing, women's clothing, men's clothing, intimates and etc. Within each department includes aisles and display fixtures, such as shelves, racks and peg hooks, for displaying the products related to the corresponding department category.

During various holiday seasons, many shoppers are in the department store to buy gifts. To make it easier and more convenient for the customer, display fixtures are located in certain department categories that display merchandise from other departments in the store. For example, in clothing departments, having a display fixture that displays accessories (which would otherwise be located in a different department) makes it easier for the customer to put together a gift without having to search out another department. Making the cross-merchandising display fixture easily accessible and aesthetically pleasing is yet another way to aid the customer in their shopping experience.

Figure 1:
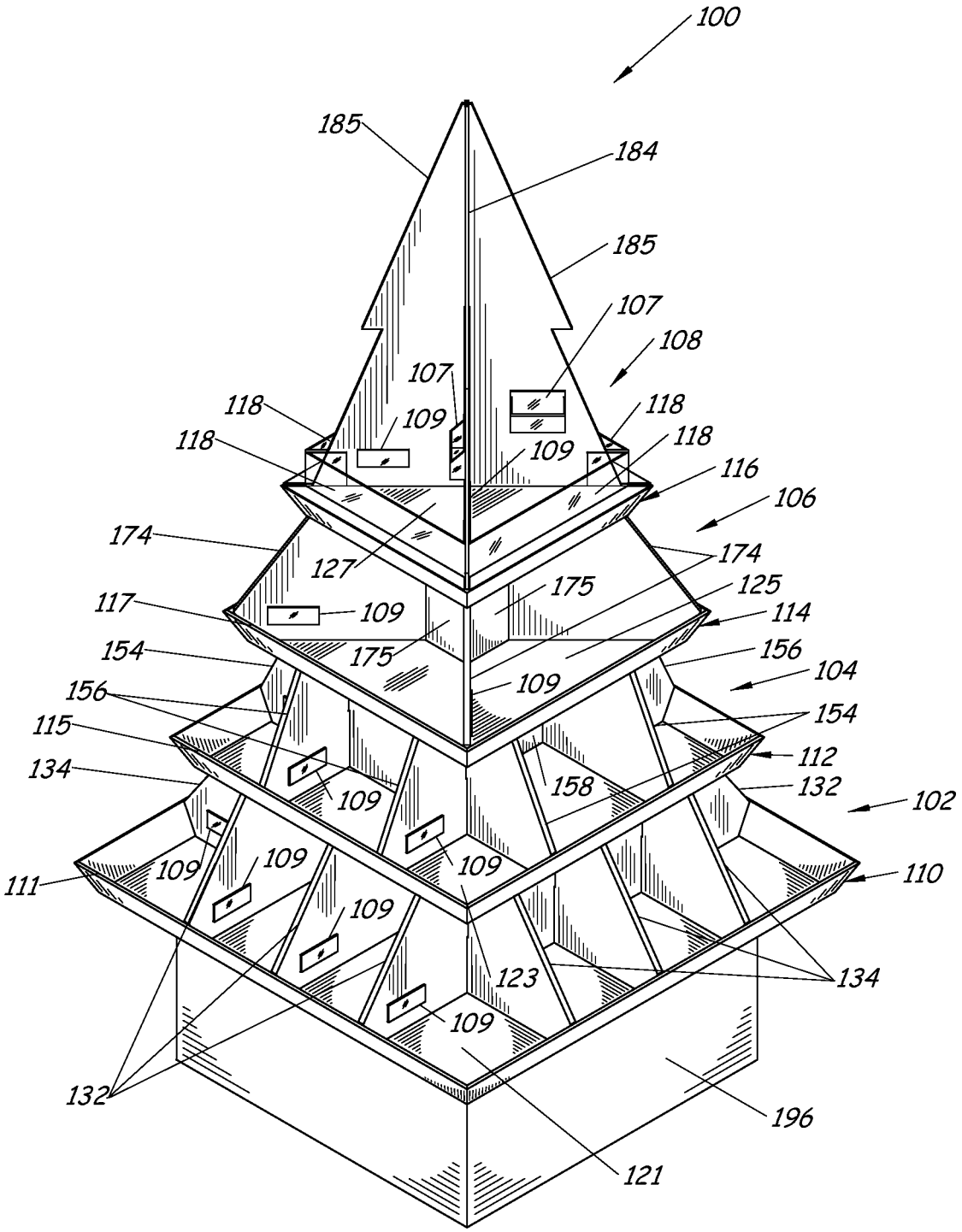
FIG. 1 is a perspective view of a display fixture according to one embodiment.
Figure 2:
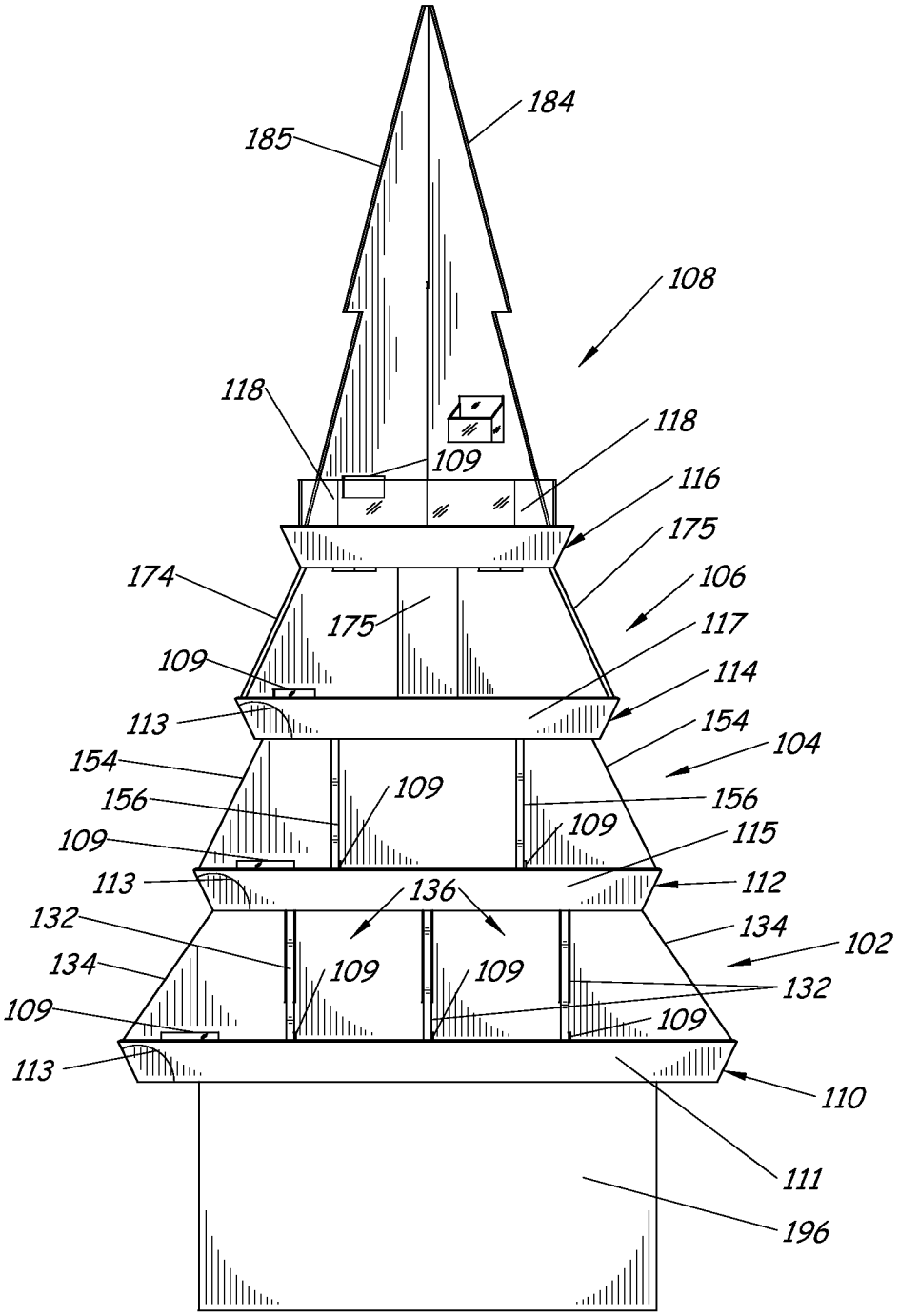
FIG. 2 is a side view of the display fixture illustrated in FIG. 1, the opposing side, the front and the rear being identical.

FIG. 1 illustrates a perspective view of a display fixture 100 according to one embodiment. FIG. 2 illustrates a side view of the display fixture illustrated in FIG. 1, where the opposing side, the front and the back are identical. Each component of display fixture 100 is shipped to a store flat or in a substantially planar configuration and is lightweight, inexpensive, and recyclable. Therefore, display fixture 100 is a temporary display fixture that can be used during a particular shopping season and then easily deconstructed for disposal. For example, components of display fixture 100 can be made of corrugated cardboard.

Display fixture 100 includes a plurality of tiers or levels 102, 104, 106 and 108 that are stacked one on top of another. More specifically, display fixture 100 includes lower tiers or levels 102 and 104 and upper tiers or levels 106 and 108. Each of the plurality of tiers or levels 102, 104, 106 and 108 include components of a tray or platform and a plurality of rectilinear partitions or dividers that form a plurality of bins or receptacles. The trays or platforms and the plurality of partitions or dividers Together, the plurality of tiers or levels 102, 104, 106 and 108 resemble a three-dimensional seasonal decoration when viewed from each side of the display fixture 100. For example, together the plurality of tiers or levels 102, 104, 106 and 108 resemble a Christmas tree. In addition, the plurality of bins or receptacles on each tier 102, 104, 106 and 108 are stocked with merchandise. For example, merchandise can be of a type that compliments the merchandise being sold in the department that display fixture 100 is placed, making display fixture 100 a cross merchandising display fixture.

The lowermost tier 102 of the lower tiers includes tray or platform 110. The uppermost tier 104 of the lower tiers includes tray or platform 112. The lowermost tier 106 of the upper tiers includes tray or platform 114. The uppermost tier of the upper tiers includes tray or platform 116. Each tray or platform 110, 112, 114 and 116 has a respective horizontal surface 121, 123, 125 and 127, and in one embodiment and as illustrated, each tray or platform 110, 112, 114 and 116 includes four sides and a square shape.

Tray or platform 110 of tier 102 is substantially horizontally oriented and includes a lip 111 located around the entirety of its periphery. Lip 111 extends upward at an angle 113 from horizontal surface 121 of tray or platform 110. Tray or platform 112 of tier 104 is substantially horizontally oriented and includes a lip 115 located around the entirety of its periphery. Lip 115 extends upward at angle 113 from horizontal surface 123 of tray or platform 112. Tray or platform 114 of tier 106 is substantially horizontally oriented and includes a lip 117 located around the entirety of its periphery. Lip 117 extends upward at angle 113 from horizontal surface 125. As illustrated, angle 113 is greater than 90 degrees, but less than 180 degrees. For example and as illustrated in FIG. 2, angle 113 is approximately 116 degrees. Tray or platform 116 of tier 108 is also substantially horizontally oriented and includes horizontal surface 127, but does not include a lip. Rather, tier 108 includes a plurality of barriers 118. As illustrated, barriers 118 are located between the partitions or dividers of tier 108 and help retain merchandise being held on tray 116 and between the partitions. In one embodiment and as illustrated in the figures, barriers 118 are transparent. Not including a lip on tray 116 and making barriers 118 transparent aids in allowing merchandise being held on tray 116 to be visible since tray 116 is closer to the eye level of a customer than the tiers 106, 104 and 102 located below tier 108. In addition and in one embodiment, the sides of tray 116 taper at the same angle as the angle of the lips of trays 110, 112 and 114 to give display fixture 100 a uniform look.

Each of the plurality of partitions or dividers is oriented substantially vertically or substantially normal to horizontal surface 121, 123, 125 and 127 so as to divide a volume between each tray and form a plurality of bins or receptacles. The lowermost tier 102 of the lower tiers includes a plurality of partitions or dividers 132, 134 and 136. The uppermost tier 104 of the lower tiers includes a plurality of partitions or dividers 154, 156 and 158. The lowermost tier 106 of the upper tiers includes a plurality of partitions or dividers 174 and 175. The uppermost tier 108 of the upper tiers includes a plurality of partitions or dividers 184 and 185. Partitions 132, 134, 136, 154, 156, 158, 174, 175, 184 and 185 will be discussed in more detail below.

As illustrated in FIGS. 1 and 2, display fixture 100 also includes an area for receiving gift card holders 107. Gift card holders 107 are, in one embodiment, transparent open top boxes that hold gift cards or other financial transaction cards for display. Gift card holders 107 are attached to a side of partitions 184 and 185 of tier 108. As also illustrated in FIGS. 1 and 2, each bin or receptacle includes a price label pocket 109 for holding a price label that matches the price of the merchandise located in its respective bin. In one embodiment, the price label pockets 109 are located on the divider or partition defining a left side of each bin or receptacle.

Figure 3:
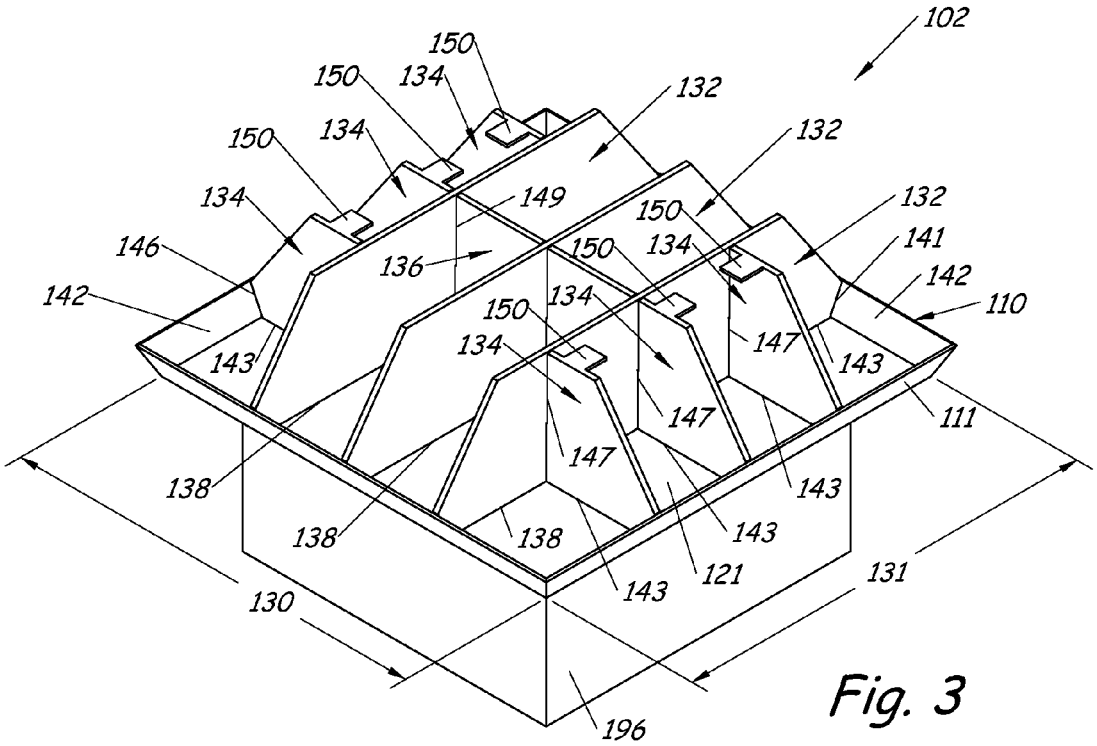
FIG. 3 is a perspective view of the lowermost tier of the lower tiers of the display fixture illustrated in FIG. 1.
Figure 4:
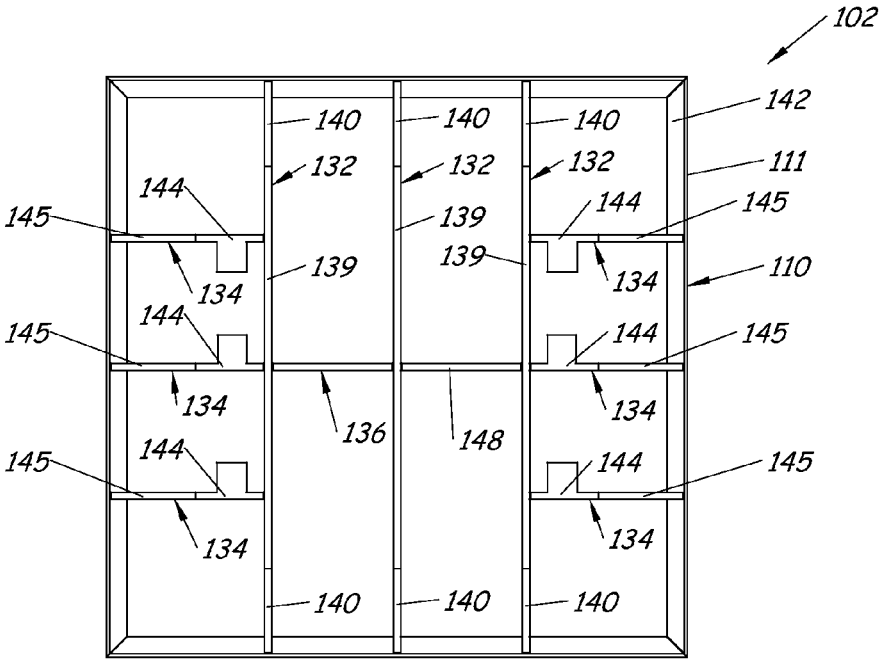
FIG. 4 is a top view of the tier illustrated in FIG. 3.

FIG. 3 is a perspective view of first tier 102 or lowermost tier 102 of the lower tiers of display fixture 100 illustrated in FIG. 1. FIG. 4 is a top view of tier 102 as illustrated in FIG. 3. As illustrated in FIG. 3, horizontally oriented tray 110 is mounted onto a base 196 and a plurality of partitions 132, 134 and 136 are mounted onto tray 110 to form a plurality of bins or receptacles. Tray 110 includes a length 130 and a width 131. In one embodiment and as illustrated, length 130 and width 131 are substantially the same such that tray 110 is in the shape of a square. In one embodiment, partitions 132, 134 and 136, which define the bins or receptacles of tier 102, are positioned on horizontally oriented tray 110 such that each partition is oriented substantially normal to two of the sides of the four-sided tray 110.

More specifically and in one embodiment, there are three elongated partitions 132 that span the width 131 of tray 110, six short partitions 134 that span the distance between one of the elongate partitions 132 and lip 111 and are oriented substantially normal to the elongate partitions 132 and one center partition 136. The one center partition 136 extends between two elongate partitions 132 and receives the other of the elongate partition 132 such that center partition 136 is divided into two parts and is oriented substantially normal to the elongate partitions 132.

Each elongate partition 132 includes a bottom edge 138, a top edge 139, two free side edges 140 and two coupling side edges 141. Each coupling side edge 141 of elongate partitions 132 abuts an interior facing surface 142 of lip 111 and the entire bottom edge 138 of each elongate partition 132 abuts horizontal surface 121 of tray 110, while free side edges 140 taper from top edges 139 to coupling side edges 141 (of which only one is shown) or a top of lip 111.

Each short partition 134 includes a bottom edge 143, a top edge 144, a free side edge 145, a short coupling side edge 146 and a long coupling side edge 147. Each short coupling side edge 146 of each short partition 134 abuts interior facing surface 142 of lip 111, each long coupling side edge 147 of each short partition 134 abuts one of the elongate partitions 132 and the entire bottom edge 143 of each short partition 134 abuts horizontal surface 121 of tray 110. Free side edges 145, like free side edges 138 of elongate partitions 132, however, taper from top edges 144 to the short coupling side edges 146 (of which only one is shown) or the top of lip 111. In addition, the top edge 144 of each short partition 134 includes a tab 150 for connecting to the tier or level located directly above tier or level 102. Tabs 150 can be connected to the tier above tier 102 using fasteners, such as push lock screws or the like.

Center partition 136 includes a bottom edge (not illustrated), a top edge 148 and two coupling side edges 149 (of which only one is shown). Each coupling side edge 149 of center partition 136 abuts one of the elongate partitions 132 and the entire bottom edge of center partition 136 abuts horizontal surface 121 of tray 110.

As illustrated in FIGS. 3 and 4, one of the elongate partitions 132 and three of the short partitions 134 divide width 131 of the right side of tray 110 into four bins or receptacles, two of the bins being corner bins defined by a portion of the elongate partition 132 and by one of the short partitions 134 and two of the bins being center bins defined by portions of the elongate partition 132 and by two of the short partitions 134. Another of the elongate partitions 132 and three of the other short partitions 134 divide width 131 of the left side of tray 110 into four bins or receptacles, two of the bins being corner bins defined by a portion of the elongate partition 132 and by one of the short partitions 134 and two of the bins being center bins defined by portions of the elongate partitions 132 and by two of the short partitions. In this way, the bins or receptacles on the right side of tray 110 mirror the bins or receptacles on the left side of tray 110. Between the bins on the right side of tray 110 and the bins on the left side of tray 110 are four additional bins of substantially equal size to each other. Two of the bins open to the front of tray 110 and two of the bins open to the back of tray 110. In particular, each of the four additional bins are defined by portions of two of the elongate partitions 132 and a portion of center partition 136, which aligns with two of the short partitions 134.

The plurality of partitions or dividers 132, 134 and 136 as illustrated in FIGS. 3 and 4 as well as base 196 structurally support a weight of a portion of display fixture 100 and a weight of merchandise located in bins above the partitions. More particularly, partitions 132, 134 and 136 structurally support a weight of second tier 104, third tier 106 and fourth tier 108 as well as the weight of merchandise that is being held on those tiers.

Figure 5:
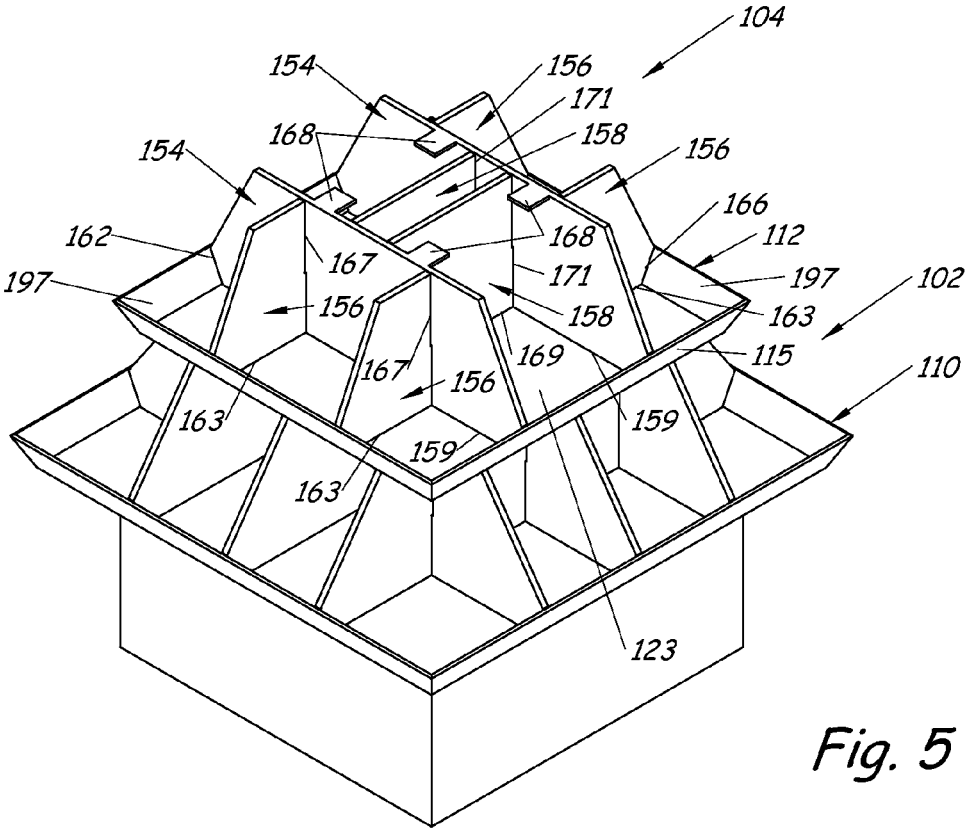
FIG. 5 is a perspective view of the uppermost tier of the lower tiers of the display fixture illustrated in FIG. 1 as mounted on top of the lowermost tier illustrated in FIGS. 3 and 4.
Figure 6:
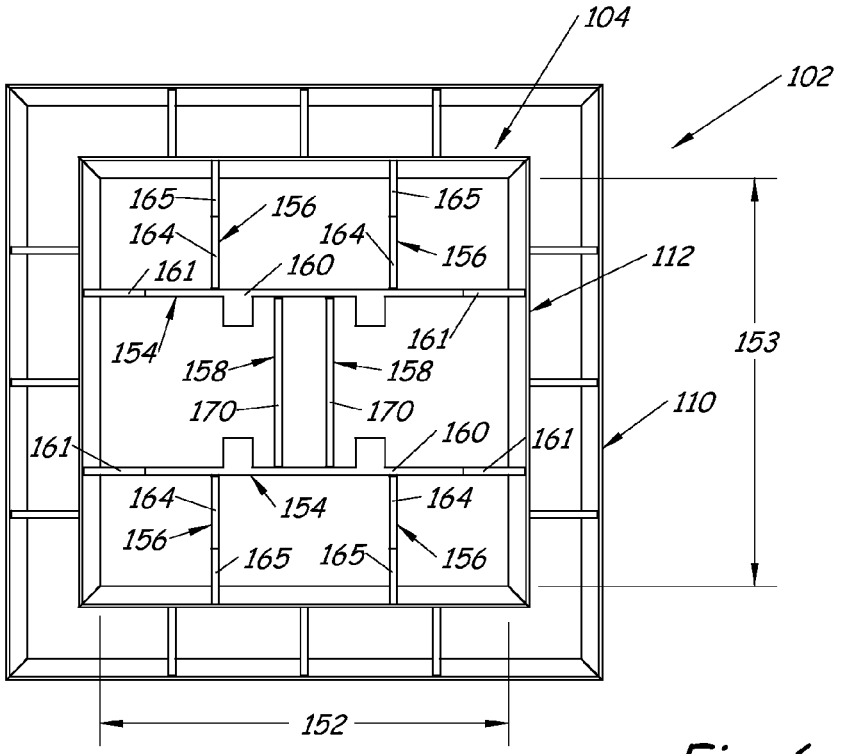
FIG. 6 is a top view of the tiers illustrated in FIG. 5.

FIG. 5 is a perspective view of a second tier 104 or uppermost tier 104 of the lower tiers of display fixture 100 as mounted on top of lowermost tier 102 of the lower tiers of display fixture 100 illustrated in FIG. 1. FIG. 6 is a top view of tiers 104 and 102 as illustrated in FIG. 5. As illustrated in FIG. 5, horizontally oriented tray 112 is mounted onto plurality of partitions 132, 134 and 136 of tier 102 and a plurality of partitions 154, 156 and 158 are mounted onto tray 112 to form a plurality of bins or receptacles. Tray 112 includes a length 152 and a width 153. In one embodiment and as illustrated, length 152 and width 153 are substantially the same such that tray 112, like tray 110, is in the shape of a square. However, length 130 of tray 110 is greater than length 152 of tray 112 and width 131 of tray 110 is greater than width 153 of tray 112. In one embodiment, partitions 154, 156 and 158, which define the bins or receptacles of tier 104, are positioned on horizontally oriented tray 112 such that each partition 154, 156 and 158 is oriented substantially normal to two of the sides of the four-sided tray 112.

More specifically and in one embodiment, two elongate partitions 154 span the length 152 of tray 112, four short partitions 156 span the distance between one of the elongate partitions 154 and lip 115 and are oriented substantially normal to the elongate partitions 154 and two center partitions 158 extend between the two elongate partitions 154 and are oriented substantially normal to the elongate partitions 154.

Each elongate partition 154 includes a bottom edge 159, a top edge 160, two free side edges 161 and two coupling side edges 162 (of which only one is shown). Each coupling side edge 162 of elongate partitions 154 abuts an interior facing surface 197 of lip 115 and the entire bottom edge 159 of each elongate partition 154 abuts horizontal surface 123 of tray 112, while free side edges 161 taper from top edges 160 to coupling side edges 162 or a top of lip 115. In addition, the top edge 160 of each elongate partition 154 includes a tab 168 for connecting to the tier or level located directly above tier or level 104. Tabs 168 can be connected to the tier above tier 104 using fasteners, such as push lock screws or the like.

Each short partition 156 includes a bottom edge 163, a top edge 164, a free side edge 165, a short coupling side edge 166 (of which only one is shown) and a long coupling side edge 167 (of which two are shown). Each short coupling side edge 166 of each short partition 156 abuts interior facing surface 197 of lip 115, each long coupling side edge 167 of each short partition 156 abuts one of the elongate partitions 154 and the entire bottom edge 163 of each short partition 156 abuts horizontal surface 123 of tray 112, while free side edges 165 like free side edges 161 of elongate partitions 154 taper from top edges 164 to short coupling side edges 166 or the top of lip 115.

Each center partition 158 includes a bottom edge 169, a top edge 170 and two coupling side edges 171 (of which two are shown). Each coupling side edge 171 of each center partition 158 abuts one of the elongate partitions 154 and the entire bottom edge 169 of each center partition 158 abuts horizontal surface 123 of tray 112.

As illustrated in FIGS. 5 and 6, one of the elongate partitions 154 and two of the short partitions 156 divide length 152 of the front of tray 112 into three bins or receptacles, two of the bins being corner bins defined by portions of one of the elongate partitions 154 and by one of the short partitions 156 and one of the bins being a center bin defined by a portion of the elongate partition 154 and by two of the short partitions 156. The other of the elongate partitions 154 and two of the other short partitions 156 divide length 152 of the back of tray 112 into three bins or receptacles, two of the bins being corner bins defined by portions of the other elongate partition 154 and by one of the short partitions 156 and one of the bins being a center bin defined by a portion of the other elongate partition 154 and by two of the short partitions 156. In this way, the bins or receptacles on the front of tray 112 mirror the bins on the back of tray 112. Between the bins on the front of tray 112 and the bins on the back of tray 112 are two additional bins of substantially equal size to each other. One bin opens to the right side of tray 112 and one bin opens to the left side of tray 112. In particular, each of the two additional bins are defined by portions of both elongate partitions 154 and one of the center partitions 158.

The plurality of partitions or dividers 154, 156 and 158 as illustrated in FIGS. 5 and 6 structurally support a weight of a portion of display fixture 100 and a weight of merchandise located in bins above partitions 154, 156 and 158. More particularly, partitions 154, 156 and 158 structurally support a weight of third tier 106 and fourth tier 108 as well as the weight of merchandise that is being held on those tiers.

Figure 7:
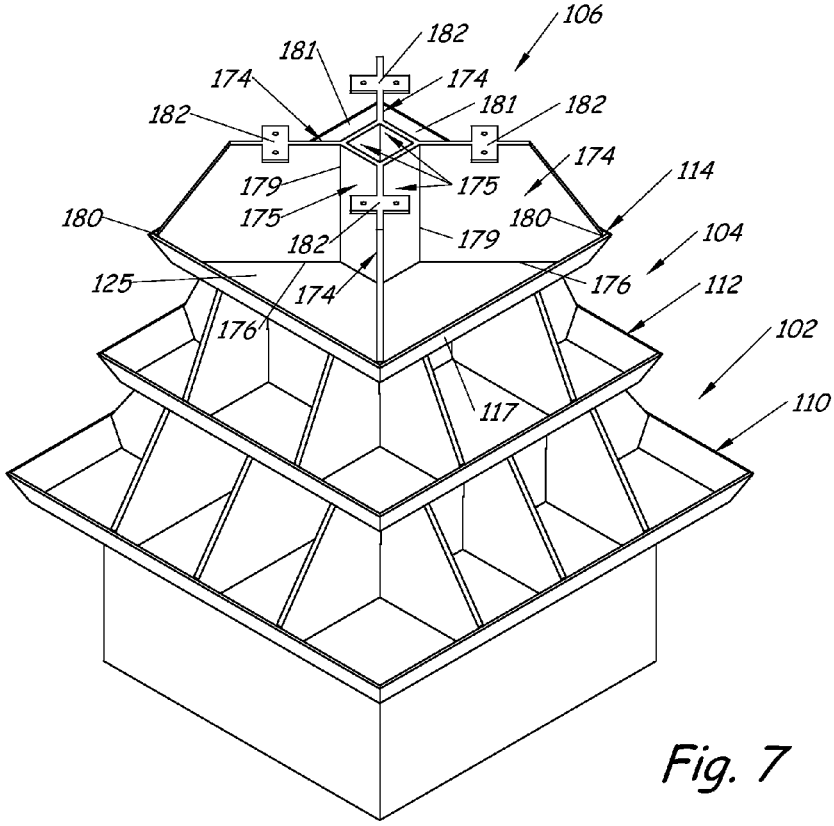
FIG. 7 is a perspective view of the lowermost tier of the upper tiers of the display fixture illustrated in FIG. 1 as mounted on top of the lower tiers illustrated in FIGS. 5 and 6.
Figure 8:
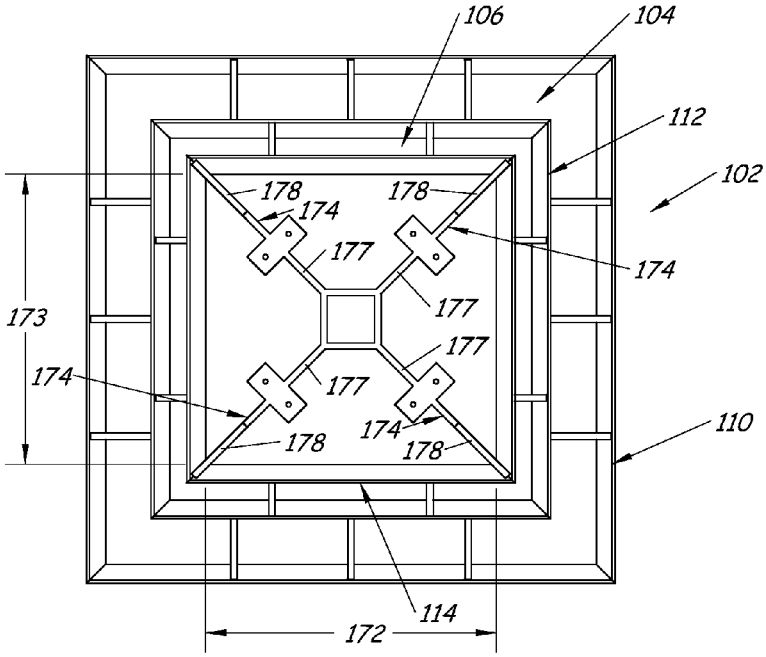
FIG. 8 is a top view of the tiers illustrated in FIG. 7.

FIG. 7 is a perspective view of a third tier 106 or lowermost tier 106 of the upper tiers of display fixture 100 as mounted on top of uppermost tier 104 of the lower tiers of display fixture 100 illustrated in FIG. 1. FIG. 8 is a top view of tiers 106, 104 and 102 illustrated in FIG. 7. As illustrated in FIG. 7, horizontally oriented tray 114 is mounted onto plurality of dividers 154, 156 and 158 of tier 104 and a plurality of partitions 174 and 175 are mounted onto tray 114 to form a plurality of bins or receptacles. Tray 114 includes a length 172 and a width 173. In one embodiment and as illustrated, length 172 and width 173 are substantially the same such that tray 114, like trays 110 and 112, is in the shape of a square. However, length 152 of tray 112 is greater than length 172 of tray 114 and width 153 of tray 112 is greater than width 173 of tray 114. In one embodiment, partitions 174 and 175, which define the bins or receptacles of tier 106, are positioned on horizontally oriented tray 114 such that each partition 174 is oriented at an angle relative to each of the four sides of tray 114. For example, the angle to which each partition 174 is angled to each side of tray 114 is less than 90 degrees.

More specifically, all four partitions 174 are connected together via center tower partitions 175 and are oriented to extend from center tower partitions 175 to each corner of tray 114.

Each partition 174 includes a bottom edge 176, a top edge 177, a free side edge 178, a coupling side edge 179 (of which two are shown) and a coupling side edge 180 (of which two are shown). Each coupling side edge 179 couples to a tower partition 175, each coupling side edge 180 abuts the intersection of two interior facing surfaces 181 of lip 117 and the entire bottom edge 176 of each partition 174 abuts horizontal surface 125 of tray 114. Free side edges 178 taper from top edges 177 to coupling side edges 180 or a top of lip 117. In addition, the top edge 177 of each partition 174 includes a tab 182 for connecting to tier or level 108 located directly above tier or level 106. Tabs 182 can be connected to the tier above tier 106 using fasteners, such as push lock screws or the like.

As illustrated in FIGS. 7 and 8, partitions 174 and 175 divide tray 114 into four bins, one of the bins being located at the front of tray 114, one of the bins being located at the back of tray 114, one of the bins being located at the right side of tray 114 and one of the bins being located at the left side of tray 114. The plurality of partitions or dividers 174 and 175 as illustrated in FIGS. 7 and 8 structurally support a weight of a portion of display fixture 100 and a weight of merchandise located in bins above partitions 174 and 175. More particularly, partitions 174 and 175 structurally support a weight of fourth tier 108 as well as the weight of merchandise that is being held on that tier.

Figure 9:
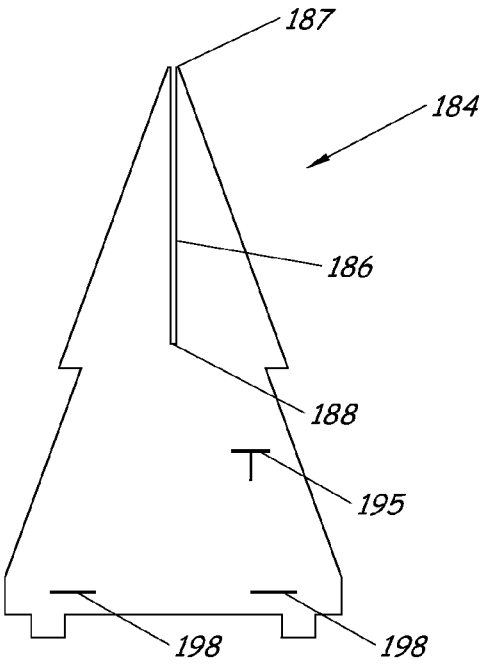
FIGS. 9 and 10 are plan views of the partitions of the uppermost tier of upper tiers of the display fixture illustrated in FIG. 1 according to one embodiment.
Figure 10:
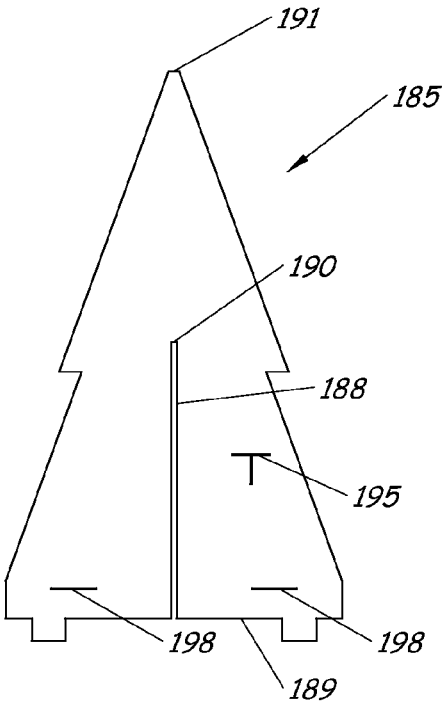
Figure 11:
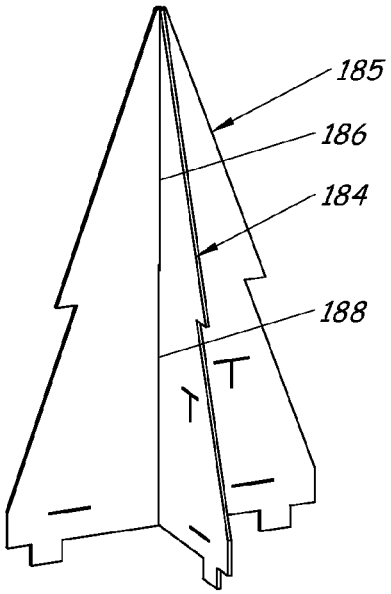
FIG. 11 illustrates the partitions illustrated in FIGS. 9 and 10 assembled together.

FIGS. 9 and 10 are plan views of partitions or dividers 184 and 185 of uppermost tier 108 of display fixture 100. FIG. 11 illustrates partitions 184 and 185 as illustrated in FIGS. 9 and 10 assembled together. First partition 184 includes a main slot 186 that extends from a top 187 to a terminating end 188 and is in alignment with a vertical center line of first partition 184. Still further, first partition 184 includes additional slots 198 for securing first partition 184 to tray 116 of tier 108 and additional slots 195 for receiving a gift card holder 107. Second partition 185 includes a main slot 188 that extends from a bottom edge 189 to a terminating end 190 and is in alignment with a vertical center line of second partition 185. Still further, second partition 185 includes additional slots 198 for securing second partition 185 to tray 116 of tier 108 and additional slots 195 for receiving a gift card holder 107.

To assemble first partition 184 and second partition 185 together to form a portion of a three-dimensional seasonal decoration, first partition 184 is oriented substantially perpendicular or normal to second partition 185, second partition 185 is inserted into or mates with slot 186 of first partition 184 along slot 188 and second partition 185 is pushed downward relative to first partition 184 until top 191 of second partition 185 is aligned with top 187 of first partition 184.

Figure 12:
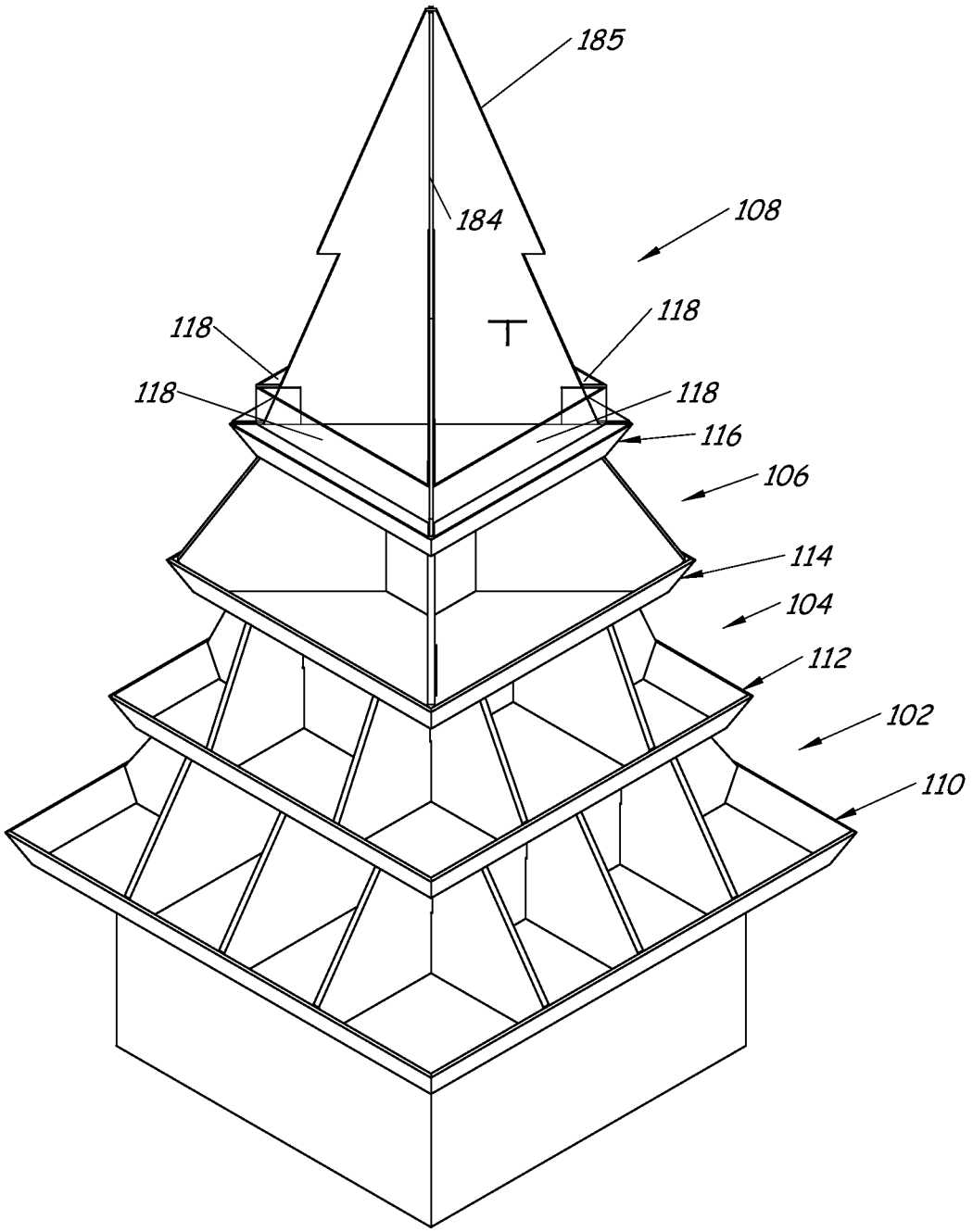
FIG. 12 illustrates a perspective view of the uppermost tier of the upper tiers of the display fixture illustrated in FIG. 1 as mounted on top of the tiers illustrated in FIGS. 7 and 8.
Figure 13:
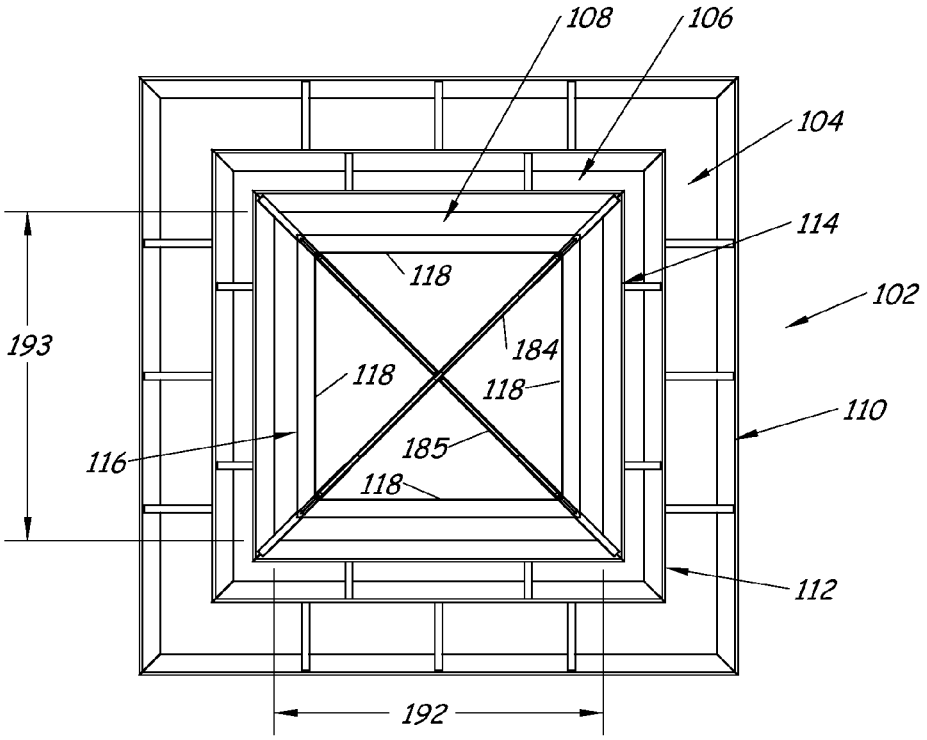
FIG. 13 illustrates a top view of the tiers illustrated in FIG. 12.

FIG. 12 is a perspective view of a fourth tier 108 or uppermost tier 108 of the upper tiers of display fixture 100 as mounted on top of lowermost tier 106 of the upper tiers of display fixture 100 illustrated in FIG. 1. FIG. 13 is a top view of tiers 108, 106, 104 and 102 as illustrated in FIG. 12. As illustrated in FIG. 12, horizontally oriented tray 116 is mounted onto plurality of partitions 174 and 175 of tier 106 and a plurality of partitions 184 and 185 are mounted onto tray 116 to form a plurality of bins or receptacles. Tray 116 includes a length 192 and a width 193. In one embodiment and as illustrated, length 192 and width 193 are substantially the same such that tray 116, like trays 110, 112 and 114, is in the shape of a square. However, length 172 of tray 114 is greater than length 192 of tray 116 and width 173 of tray 114 is greater than width 193 of tray 116. In one embodiment, partitions 184 and 185, which define the bins or receptacles of tier 108, are positioned and secured on horizontally oriented tray 116 and are oriented at an angle relative to each of the four sides of tray 116. In one embodiment, partitions 184 and 185 are oriented to extend from the vertical center line of each partition 184 and 185 to each corner of tray 116 or at an angle that is less than 90 degrees from each side.

As illustrated in FIGS. 12 and 13, partitions 184 and 185 divide tray 116 into four bins and, as previously discussed, barriers 118 help retain merchandise being held on tray 116 and within partitions 184 and 185. In particular, one of the bins is open to the front of tray 116, one of the bins is open to the back of tray 116, one of the bins is open to the right side of tray 116 and one of the bins is open to the left side of tray 116.

Figure 14:
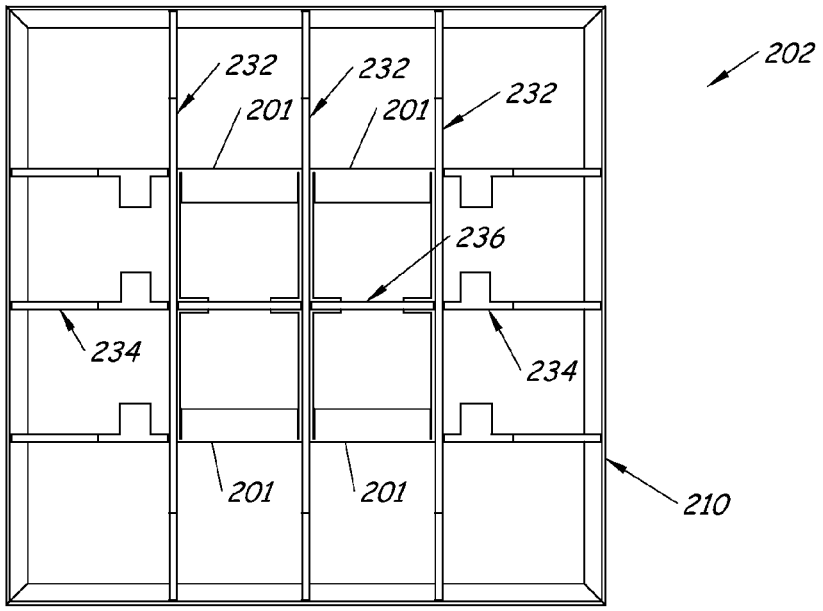
FIG. 14 is a top view of an alternative configuration of bins of the lowermost tier of the lower tiers according to another embodiment.

FIG. 14 is a top view of an alternative configuration 202 of a plurality of bins of a lowermost tier 102 of the lower tiers according to another embodiment. In the configuration illustrated in FIG. 14, a plurality of removable fillers 201 are inserted into select bins located between the bins located on the right side of tray 210 and the bins located on the left side of tray 210. Each select bin is defined by portions of two elongate partitions 232 and a portion of center partition 236, which aligns with two short partitions 234. Each removable filler 201 decreases a depth of the bin to which it is inserted. In particular, each removable filler 201 is inserted into one of the select bins and pushed to abut a portion of center partition 236. As illustrated in FIG. 14, each removable filler 201 has a square or cube like shape for occupying a cubical volume of space.

Figure 15:
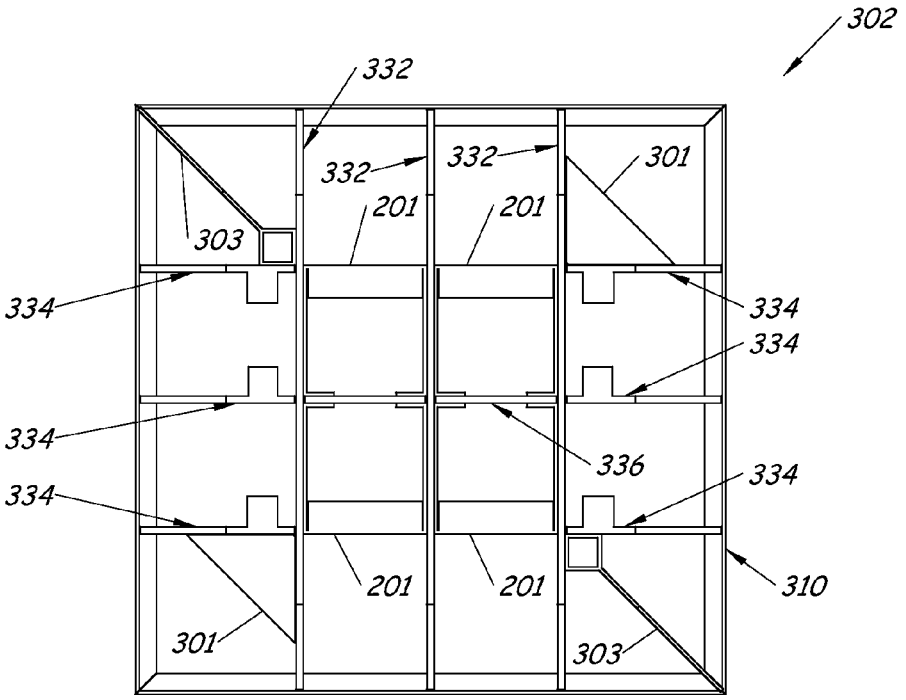
FIG. 15 is a top view of another alternative configuration of bins of the lowermost tier of the lower tiers according to yet another embodiment.

FIG. 15 is a top view of another alternative configuration 302 of bins of the lowermost tier 102 of the lower tiers according to yet another embodiment. Like configuration 202 illustrated in FIG. 14, configuration 302 of the lowermost tier includes a plurality of removable fillers 201 that are inserted into select bins located between the bins located on the right side of tray 310 and the bins located on the left side of tray 310. Each select bin is defined by portions of two elongate partitions 332 and a portion of center partitions 336, which aligns with two short partitions 334. As described above, each removable filler 201 decreases a depth of the bin to which it is inserted. In particular, each removable filler 201 is inserted into one of the select bins and pushed to abut a portion of center partition 336. As illustrated in FIGS. 14 and 15, each removable filler 201 has a square or cube like shape for occupying a cubical volume of space.

In the configuration illustrated in FIG. 15, configuration 302 also includes two removable fillers 301 that are inserted into two corner bins that are located opposite from each other. Each of the two select corner bins is defined by a portion of one of the elongate partitions 332 and one short partition 334. Each removable filler 301 decreases the usable space of the corner bin in which it is inserted. In particular, each removable filler 301 is inserted into one of the select corner bins and pushed so that it abuts a portion of one of the elongate partitions 332 and a portion of one of the short partitions 334. As illustrated in FIG. 15, each removable filler 301 has a triangular shape for occupying a triangular volume of space of a corner.

In the configuration illustrated in FIG. 15, configuration 302 also includes two removable partitions or dividers 303 that are inserted into the other two corner bins that are located opposite from each other. Each of the two of the other corner bins is defined by a portion of one of the elongate partitions 332 and one short partition 334. Each removable partition 303 divides the corner bin to which it is inserted into two bins. In particular, each removable partition 303 is inserted into one of the other select corner bins and pushed so the back, which as a square elongated shape, abuts a portion of one of the elongate partitions 332 and a portion of one of the short partitions 334.

Figure 16:
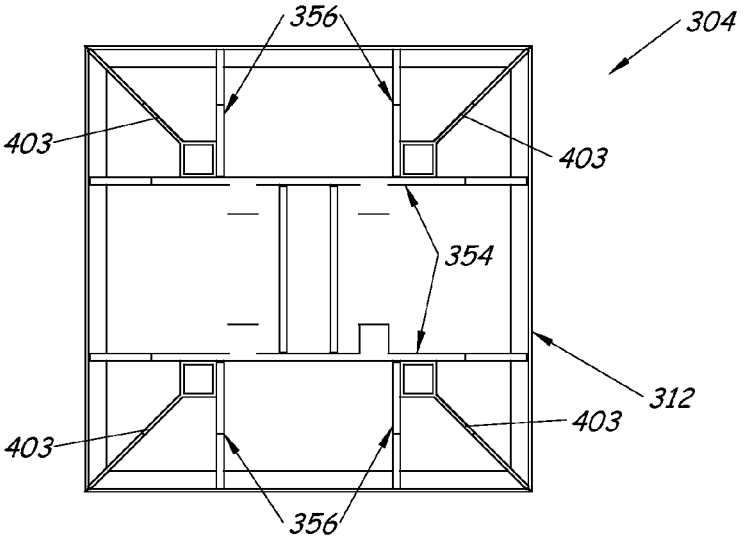
FIG. 16 is a top view of an alternative configuration of bins of the uppermost tier of the lower tiers according to another embodiment.

FIG. 16 is a top view of an alternative configuration 304 of bins of the uppermost tier 104 of the lower tiers according to another embodiment. In the configuration 304 illustrated in FIG. 16, a plurality of removable partitions 403 are inserted into each corner bin of tray 312. Each removable partition 403 divides each corner bin, to which it is inserted, into two bins. In particular, each removable partition 403 is inserted into one of the corner bins so the back, which has a square elongated shape, abuts a portion of an elongate partition 354 and a portion of a short partition 356.

Figure 17:
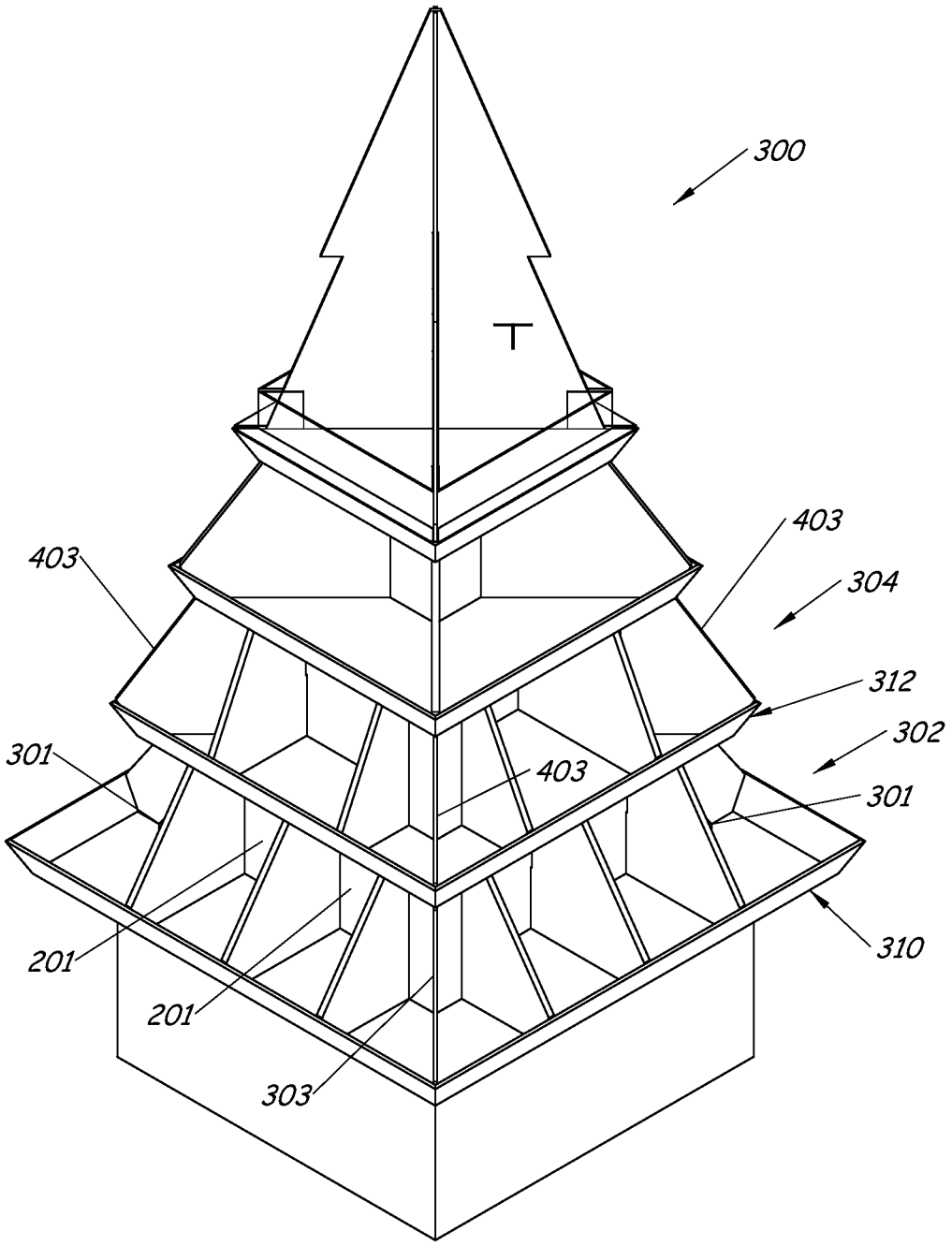
FIG. 17 illustrates a perspective view of a display fixture including the alternative configuration of bins illustrated in FIGS. 15 and 16 according to another embodiment.

FIG. 17 illustrates a perspective view of another embodiment of a display fixture 300 including the alternative configuration 302 of bins in lowermost tier 102 and alternative configuration 304 of bins in uppermost tier 104 of the lower tiers as illustrated in FIGS. 15 and 16. In comparison to display fixture 100 and in using removable fillers 201 in lowermost tier 302 of display fixture 300, a portion of the eight center bins are converted so that all eight bins have the substantially same depth. In using removable fillers 301 in lowermost tier 302, two opposing corner bins are converted to having a decreased depth. In using removable partitions 303 in lowermost tier 302, the other two opposing corner bins are converted to separating those two corner bins into four corner bins. In using removable partitions 403 in tier 304, all corner bins of tier 304 are converted to separating the corner bins into two corner bins. Therefore, rather than display fixture 300 including only four corner bins in tier 304, display fixture 300 includes eight corner bins in tier 304.

Figure 18:
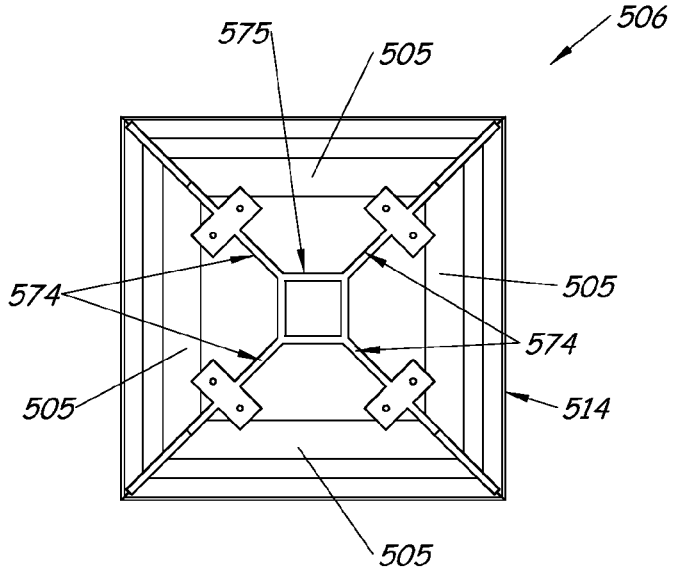
FIG. 18 is a top view of an alternative configuration of bins of the lowermost tier of the upper tiers according to another embodiment.

FIG. 18 is a top view of an alternative configuration 506 of bins of the lowermost tier 106 of the upper tiers according to another embodiment. In the configuration 506 illustrated in FIG. 18, a plurality of removable dowels 505 are inserted and positioned across all bins of tier 106. Dowels 505 can include a variety of different shapes. In one embodiment, dowels 505 are cylindrical while in other embodiments dowels 505 are only rounded on one side. Each bin of tier 106 is defined by two partitions 574 and a tower partition 575. Each removable dowel 505 extends from partition 574 to partition 574 without contacting tray 514 or tower partition 575 and is configured to receive merchandise that requires a rod type display mechanism. For example, headbands, watches and the like.

Figure 19:
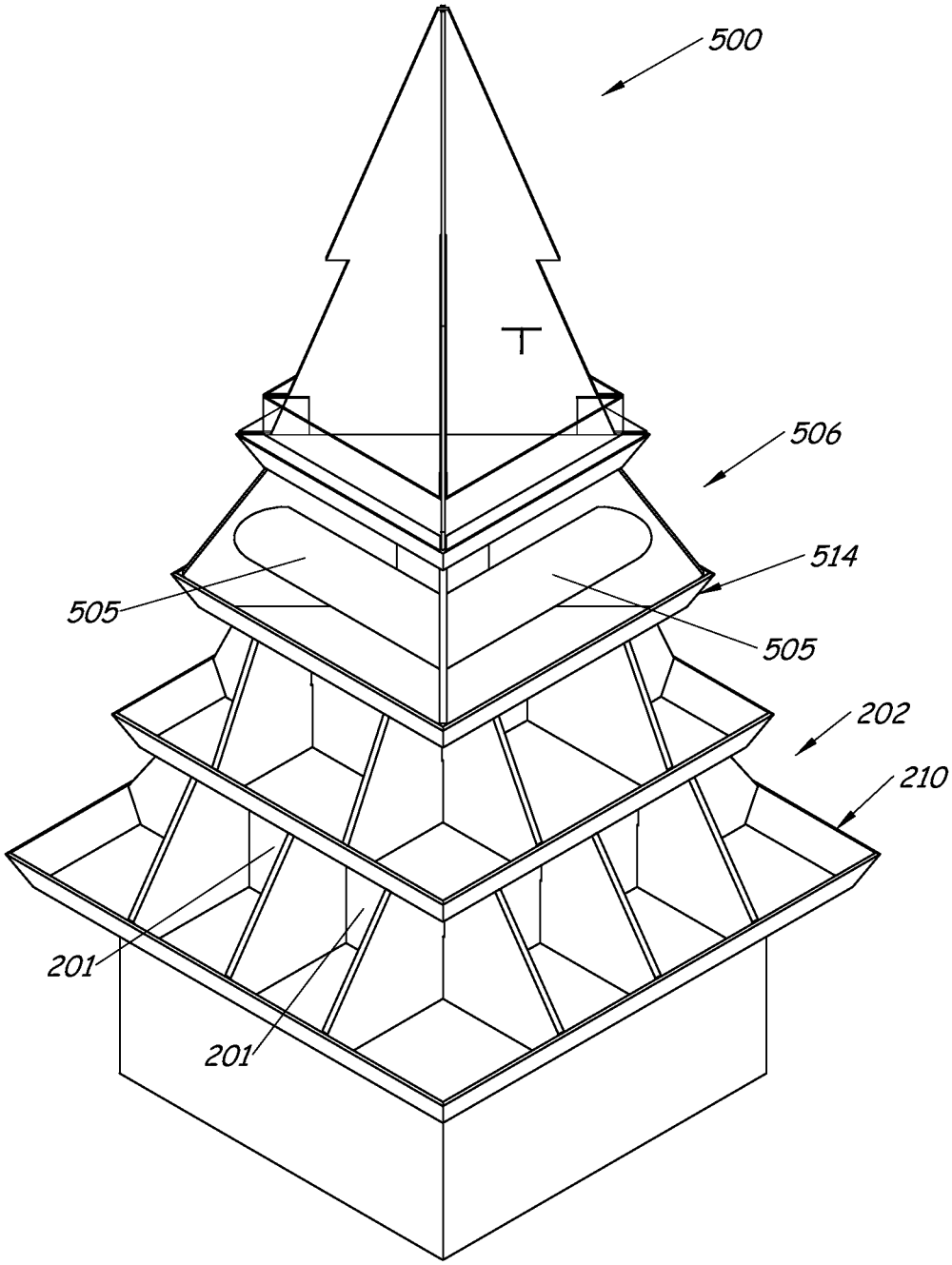
FIG. 19 illustrates a perspective view of a display fixture including the alternative configurations of bins illustrated in FIGS. 14 and 18 according to yet another embodiment.

FIG. 19 illustrates a perspective view of a display fixture 500 including the alternative configuration 202 of bins of lowermost tier 102 illustrated in FIG. 14 and the alternative configuration 504 of bins of uppermost tier 104 of the lower tiers as illustrated in FIG. 18. In comparison to display fixture 100 and in using removable fillers 201 in lowermost tier 202 of display fixture 500, a portion of the eight center bins are converted so that all eight bins have the substantially same depth. In using removable dowels 505 in tier 506, all bins of tier 506 are converted to also displaying merchandise that can be displayed on a rod.

Figure 20:
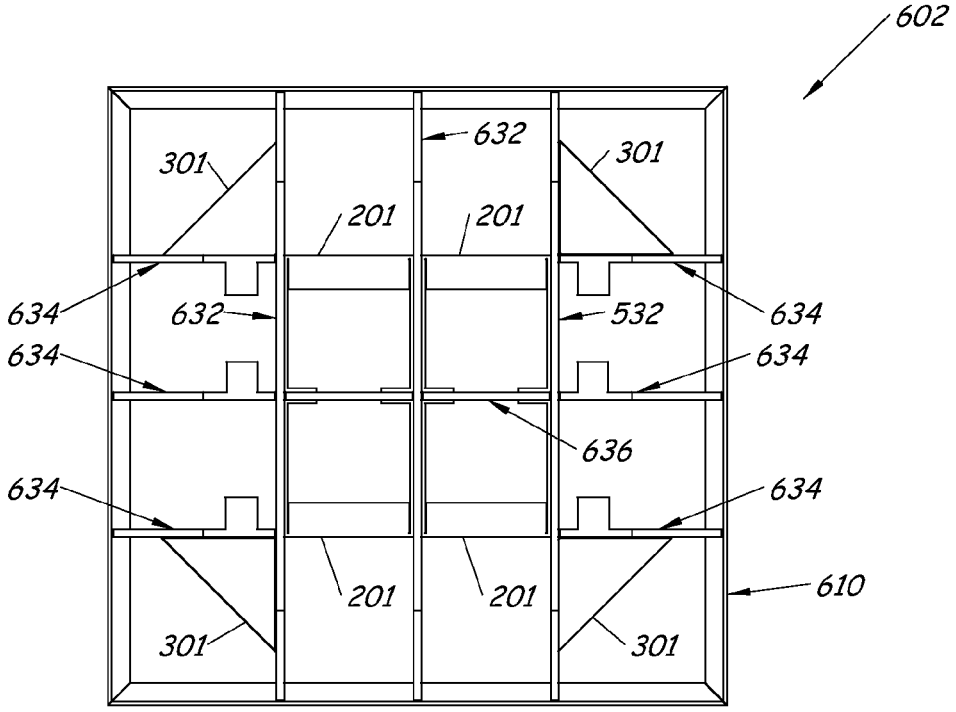
FIG. 20 is a top view of yet another alternative configuration of bins of the lowermost tier of the lower tiers according to yet another embodiment.

FIG. 20 is a top view of another alternative configuration 602 of bins of the lowermost tier 102 of the lower tiers according to yet another embodiment. Like the configuration illustrated in FIGS. 14 and 15, lowermost tier 102 of the lower tiers includes a plurality of removable fillers 201 that are inserted into select bins located between the bins located on the right side of tray 610 and the bins located on the left side of tray 610. Each select bin is defined by portions of two elongate partitions 632 and a portion of center partitions 636, which aligns with two short partitions 634. As described above, each removable filler 201 decreases a depth of the bin in which it is inserted. In particular, each removable filler 201 is inserted into one of the select bins and pushed to abut a portion of a side of center partition 636. As illustrated in FIGS. 14, 15 and 20, each removable filler 201 has a square or cube-like shape for occupying a cubical volume of space.

In the configuration 602 illustrated in FIG. 20, a plurality of removable fillers 301 are inserted into each corner bin of tray 610. Each removable filler 301 decreases the usable space of the corner bin to which it is inserted. In particular, each removable filler 301 is inserted into one of the corner bins so that it abuts a portion of a side of one of the elongate partitions 632 and a portion of one of the short partitions 634. As illustrated in FIG. 20, each removable filler 301 has a triangular shape for occupying a triangular volume of space of a corner.

Figure 21:
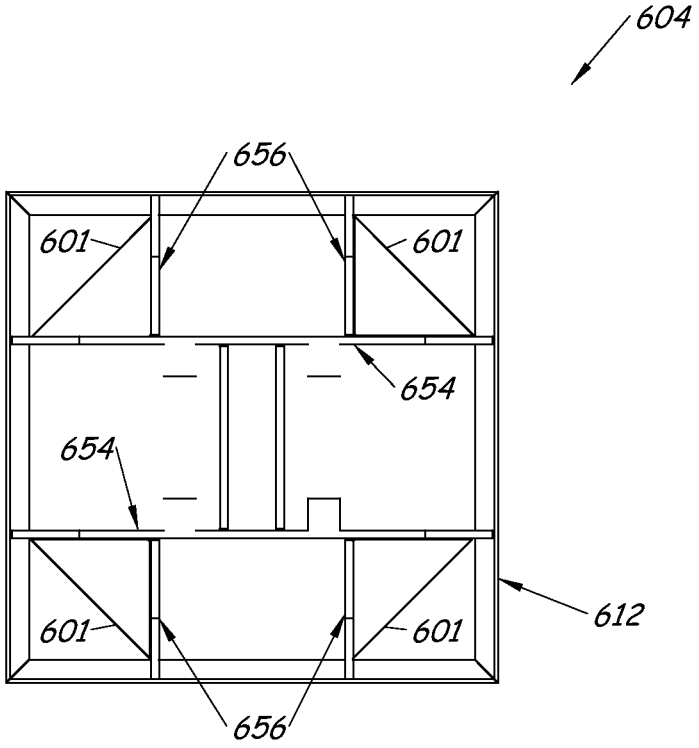
FIG. 21 is a top view of yet another alternative configuration of bins of the uppermost tier of the lower tiers according to yet another embodiment.

FIG. 21 is a top view of an alternative configuration 604 of bins of the uppermost tier 104 of the lower tiers according to another embodiment. In the configuration illustrated in FIG. 21, a plurality of removable fillers 601 are inserted into each corner bin of tray 612. Each removable filler 601 decreases the usable space of the corner bin to which it is inserted. In particular, each removable filler 601 is inserted into one of the corner bins so that it abuts a portion of one of the elongate partitions 654 and a portion of one of the short partitions 656. As illustrated in FIG. 21, each removable filler 601 has a triangular shape for occupying a triangular volume of space of a corner.

Figure 22:
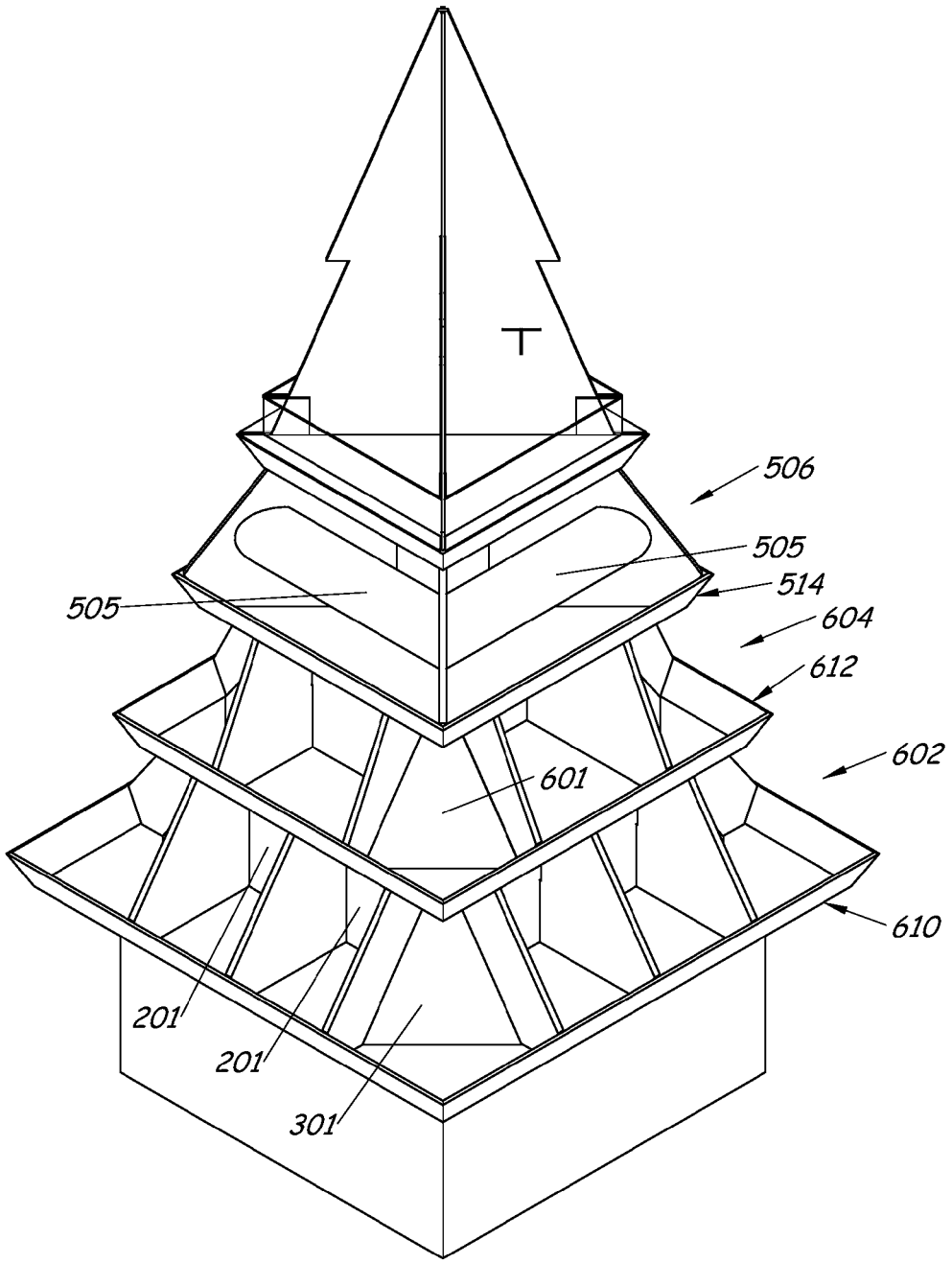
FIG. 22 illustrates a perspective view of a display fixture including the alternative configurations of bins illustrated in FIGS. 18, 20 and 21 according to yet another embodiment.

FIG. 22 illustrates a perspective view of a display fixture 600 including the alternative configuration 602 of bins of lowermost tier 102 illustrated in FIG. 20, the alternative configuration 604 of bins of uppermost tier 104 of the lower tiers as illustrated in FIG. 21 and the alternative configuration 506 of bins of lowermost tier 106 of the upper tiers as illustrated in FIG. 18. In comparison to display fixture 100 and in using removable fillers 201 and removable fillers 301 in lowermost tier 102 of display fixture 600, a portion of the eight center bins are converted so that all eight bins have the substantially same depth and all of the corner bins are converted to having a decreased depth. In using removable fillers 601, all the corner bins of tier 104 are converted to having a decreased depth. In using removable dowels 505 in tier 506, all bins of tier 506 are converted to also displaying merchandise that can be displayed on a rod.

Although FIGS. 14-22 illustrate various alternative configurations of bin arrangements on tiers 102, 104 and 106 than the bin arrangements illustrated in FIGS. 1-8, other types of bin arrangements than those that are illustrated are possible. For example, different types of removable fillers, removable dividers and removable dowels can be placed within any of the bins of display fixture 100 to create different configurations of displaying merchandise. In addition, display fixture 100 can be of a variety of different materials. In some embodiments, display fixture 100 can be made of corrugated cardboard. In other embodiments, display fixture 100 can be made of foam core, wood, metal, and the like.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a plurality of tiers stacked one on top of another, each tier including a substantially horizontally oriented tray; and a plurality of dividers oriented substantially vertically that divide a volume between each tray into a plurality of bins, wherein each divider structurally supports a weight of the display fixture and a weight of merchandise located in the bins of the display fixture that are located above each divider; and a plurality of open top boxes for holding gift cards, wherein each divider of an uppermost tier of the plurality of tiers comprises a side that includes a slot for receiving one of the open top boxes; and wherein the plurality of tiers together have a three-dimensional tree-like appearance when viewed from each side of the display fixture.

2. The display fixture of claim 1, wherein a first tray of the plurality of trays is a lowermost tray and comprises a length and a width that are greater than a length and a width of a second tray of the plurality of trays that is located directly above the first tray.

3. The display fixture of claim 2, wherein the length and the width of the second tray of the plurality of trays are greater than a length and a width of a third tray of the plurality of trays that is located directly above the second tray.

4. The display fixture of claim 3, wherein the length and the width of the third tray of the plurality of trays are greater than a length and a width of a fourth tray of the plurality of trays that is located directly above third tray.

5. The display fixture of claim 1, wherein the plurality of dividers that are located on an uppermost tray of the plurality of trays has a tree-like top.

6. The display fixture of claim 1, further comprising a removable filler insertable into one of the plurality of bins to decrease a depth of the bin.

7. The display fixture of claim 1, further comprising a removable divider insertable into one of the plurality of bins to divide the bin into two bins.

8. The display fixture of claim 1, further comprising a removable dowel for attaching to and extending between two dividers.

9. The display fixture of claim 1, wherein the each of the plurality of dividers comprises a top edge, a bottom edge and a free side edge, wherein the free side edge tapers downwardly from the top edge to each substantially horizontally oriented tray.

10. The display fixture of claim 1, wherein the three-dimensional tree-like appearance comprises a Christmas tree.

11. The display fixture of claim 1, further comprising a removable filler insertable into one of the plurality of bins to decrease a depth of the bin.

12. A display fixture comprising:

at least one lower level that includes a four-sided platform having a substantially horizontal surface and a lip that surrounds a periphery of the substantially horizontal surface and extends upward from the substantially horizontal surface at an angle relative to the substantially horizontal surface that is greater than 90 degrees and less than 180 degrees, wherein the at least one lower level further includes a plurality of rectilinear partitions dividing the four-sided platform into receptacles for holding merchandise, each partition of the at least one lower level is oriented substantially normal to two sides of the four-sided platform; and at least one upper level that includes a four-sided platform having a substantially horizontal surface and a lip that surrounds a periphery of the substantially horizontal surface and extends upward from the substantially horizontal surface at an angle relative to the substantially horizontal surface that is greater than 90 degrees and less than 180 degrees, wherein the at least one upper level further includes a plurality of rectilinear partitions dividing the four-sided platform of the at least one upper level into receptacles for holding merchandise, each partition of the at least one upper level is oriented at an angle relative to each side of the four-sided platform that is greater than 0 degrees and less than 90 degrees; and wherein the substantially horizontal surface of the at least one lower level is larger than the substantially horizontal surface of the at least one upper level and the at least one lower level and the at least one upper level together have a three-dimensional tree-like appearance when viewed from each side of the display fixture; and wherein each partition of each lower level includes at least one edge that abuts the lip and at least one free edge that tapers and extends linearly from a top of the lip to a four-sided platform located above.

13. The display fixture of claim 12, further comprising a plurality of open top boxes for holding gift cards, wherein each partition of the at least one upper level comprises a side that includes a slot for receiving one of the open top boxes.

14. The display fixture of claim 12, further comprising a plurality of price label pockets, wherein each receptacle of the at least one lower level and each receptacle of the at least one upper level comprises at least one side that receives one of the price label pockets.

15. A display fixture comprising:

a plurality of tiers stacked one on top of another, each tier including a substantially horizontally oriented tray; and a plurality of dividers oriented substantially vertically that divide a volume between each tray into a plurality of bins, wherein each divider structurally supports a weight of the display fixture and a weight of merchandise located in the bins of the display fixture that are located above each divider; and a plurality of price label pockets, wherein each bin of each of the plurality of tiers comprises at least one side that receives one of the price label pockets; and wherein the plurality of tiers together have a three-dimensional tree-like appearance when viewed from each side of the display fixture.

16. The display fixture of claim 15, wherein a first tray of the plurality of trays is a lowermost tray and comprises a length and a width that are greater than a length and a width of a second tray of the plurality of trays that is located directly above the first tray.

17. The display fixture of claim 16, wherein the length and the width of the second tray of the plurality of trays are greater than a length and a width of a third tray of the plurality of trays that is located directly above the second tray.

18. The display fixture of claim 17, wherein the length and the width of the third tray of the plurality of trays are greater than a length and a width of a fourth tray of the plurality of trays that is located directly above third tray.

19. The display fixture of claim 15, wherein the plurality of dividers that are located on an uppermost tray of the plurality of trays has a tree-like top.

20. The display fixture of claim 15, further comprising a removable divider insertable into one of the plurality of bins to divide the bin into two bins.

* * * * *